US009866985B2

(12) United States Patent
Shi et al.

(10) Patent No.: US 9,866,985 B2
(45) Date of Patent: Jan. 9, 2018

(54) AUDIO SIGNAL OUTPUT DEVICE AND METHOD, ENCODING DEVICE AND METHOD, DECODING DEVICE AND METHOD, AND PROGRAM

(71) Applicant: SONY CORPORATION, Tokyo (JP)

(72) Inventors: Runyu Shi, Tokyo (JP); Toru Chinen, Kanagawa (JP); Yuki Yamamoto, Tokyo (JP); Mitsuyuki Hatanaka, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 38 days.

(21) Appl. No.: 14/893,444

(22) PCT Filed: May 21, 2014

(86) PCT No.: PCT/JP2014/063410
§ 371 (c)(1),
(2) Date: Nov. 23, 2015

(87) PCT Pub. No.: WO2014/192603
PCT Pub. Date: Dec. 4, 2014

(65) Prior Publication Data

US 2016/0127847 A1 May 5, 2016

(30) Foreign Application Priority Data

May 31, 2013 (JP) ..... 2013-115725

(51) Int. Cl.
*H04R 5/02* (2006.01)
*H04S 7/00* (2006.01)
(Continued)

(52) U.S. Cl.
CPC ..... *H04S 7/301* (2013.01); *G10L 19/008* (2013.01); *G10L 21/034* (2013.01); *H04S 7/302* (2013.01); *H04S 7/308* (2013.01); *H04S 5/005* (2013.01)

(58) Field of Classification Search
CPC ..... H04S 7/301; H04S 7/302; H04S 7/308; H04S 5/005; H04S 5/00; H04S 1/002;
(Continued)

(56) References Cited

U.S. PATENT DOCUMENTS

2005/0220309 A1 10/2005 Hirata et al.
2007/0140497 A1 6/2007 Moon et al.
(Continued)

FOREIGN PATENT DOCUMENTS

CN 1240565 A 1/2000
CN 101009952 A 8/2007
(Continued)

OTHER PUBLICATIONS

Ville Pulkki, "Virtual Sound Source Positioning Using Vector Base Amplitude Panning", Journal of the Audio Engineering Society, Inc., Jun. 1997, pp. 11, vol. 45, No. 6, Finland.
(Continued)

*Primary Examiner* — Md S Elahee
*Assistant Examiner* — Sabrina Diaz
(74) *Attorney, Agent, or Firm* — Chip Law Group

(57) ABSTRACT

The present technology relates to an audio signal output device and a method, an encoding device and a method, a decoding device and a method, and a program for realizing audio reproduction with a more realistic feeling.
In a case where an audio signal generated to be output as a sound from an ideal speaker that is a virtual speaker placed in an ideal position is input, the distance between the ideal speaker and a real reproduction speaker is determined. Gain
(Continued)

adjustment is then performed on the audio signal with the gain corresponding to the determined distance, the audio signal subjected to the gain adjustment is reproduced by the reproduction speaker. Accordingly, even in a case where there is a difference in position between the ideal speaker and the reproduction speaker, audio reproduction with a more realistic feeling can be realized. The present technology can be applied to reproduction devices.

18 Claims, 10 Drawing Sheets

(51) Int. Cl.
*G10L 21/034* (2013.01)
*G10L 19/008* (2013.01)
*H04S 5/00* (2006.01)

(58) Field of Classification Search
CPC . H04S 2420/01; G10L 19/008; G10L 21/034; H04R 5/00; H04R 5/02
USPC ..... 381/17, 22, 23, 300, 303, 307
See application file for complete search history.

(56) References Cited

U.S. PATENT DOCUMENTS

| | | | | |
|---|---|---|---|---|
| 2007/0253561 | A1 | 11/2007 | Williams et al. | |
| 2012/0213391 | A1 | 8/2012 | Usami et al. | |
| 2013/0003999 | A1* | 1/2013 | Reverchon ..... | H04S 7/30 381/307 |

FOREIGN PATENT DOCUMENTS

| | | | |
|---|---|---|---|
| EP | 1881740 | A2 | 1/2008 |
| JP | H08-065169 | A | 3/1996 |
| JP | 2006-101248 | A | 4/2006 |
| JP | 2010-041190 | A | 2/2010 |
| WO | 2006/123461 | A1 | 11/2006 |

OTHER PUBLICATIONS

Extended European Search Report of EP Patent Application No. 14804703.8, dated Feb. 13, 2017, 8 pages.
Office Action for CN Patent Application No. 201480029763.7, dated Dec. 15, 2016, 9 pages of Office Action and 12 pages of English Translation.

* cited by examiner

FIG. 4

| NUMBER OF LFE IDEAL SPEAKERS | NUMBER OF LFE REPRODUCING SPEAKERS | GAIN MAPPING FUNCTION MixGain_io |
|---|---|---|
| 1 | 1 | MixGain_11=MixGain_22=0dB |
| 2 | 2 | MixGain_12=MixGain_21=−∞dB |
| 1 | 2 | MixGain_11=MixGain_12=−3dB |
| 2 | 1 | MixGain_11=MixGain_21=−3dB |

FIG. 8

| Syntax | No. of bits |
|---|---|
| scene_description_header(){ | |
| if(down mix coef exist flag=="1"){ | 1 |
| if(down mix coef mode){ | 1 |
| if(polyline curve idx=="111"){ | 3 |
| i=0;j=0; | |
| while(i<16 \|\| j<64){ | |
| if(polyline curve coeffcient[j]=="1")i++; | 1 |
| j++; | |
| } | |
| } | |
| }else{ | |
| if (function curve idx=="111") { | 3 |
| for(i=0;i<3;i++){ | |
| function_curve_coeffcient[i]; | 8 |
| } | |
| } | |
| } | |
| minimun_gain_threshold_idx | 4 |
| gain_correction_coeffcient | 7 |
| if(sound_level_exist_flag=="1") { | 1 |
| for(i=0; i<number of channnels; i++) { | |
| channel sound level[i]; | 10 |
| } | |
| } | |
| } | |
| } | |

AUDIO SIGNAL OUTPUT DEVICE AND METHOD, ENCODING DEVICE AND METHOD, DECODING DEVICE AND METHOD, AND PROGRAM

TECHNICAL FIELD

The present technology relates to an audio signal output device and a method, an encoding device and a method, a decoding device and a method, and a program, and more particularly, to an audio signal output device and a method, an encoding device and a method, a decoding device and a method, and a program that are designed to be capable of audio reproduction with a more realistic feeling.

BACKGROUND ART

In multichannel audio reproduction, the positions of the speakers on the reproducing side preferably correspond to the positions of the sound sources. In reality, however, the positions of the speakers on the reproducing side often differ from the positions of the sound sources.

Where the positions of the speakers on the reproducing side differ from the positions of the sound sources, there is occurrence of a sound source that is not located in the speaker's position, therefore how to reproduce the sound of such sound sources is a critical issue.

A technique called VBAP (Vector Base Amplitude Panning) has been suggested as a method of reproducing the sound of a sound source located in a desired position through a speaker located in a desired position (see Non-Patent Document 1, for example).

By VBAP, a target normal position of a sound image is expressed by a linear sum of vectors extending toward two or three speakers located around the normal position. The coefficients by which the respective vectors are multiplied in the linear sum are used as the gains of the audio signals to be output from the respective speakers, and gain adjustment is performed so that a sound image is fixed in the target position.

CITATION LIST

Non-Patent Document

Non-Patent Document 1: Ville Pulkki, "Virtual Sound Source Positioning Using Vector Base Amplitude Panning", Journal of AES, vol. 45, no. 6, pp. 456-466, 1997

SUMMARY OF THE INVENTION

Problems to be Solved by the Invention

Meanwhile, a sound reproduction method has been suggested for a conventional situation where the number of channels and the speaker arrangement on the sound source side, and the number of channels of speakers and the speaker arrangement on the reproducing side are determined in advance, like 7.1 channel arrangement and 5.1 channel arrangement, 5.1 channel arrangement and 2.1 channel arrangement, or 22.2 channel arrangement and 5.1 channel arrangement, as recommended in several international standardization conferences. In such a case, sounds are output from the respective speakers with appropriate gains by virtue of a down-mixing process, and audio reproduction with a realistic feeling can be realized.

In the other cases such as a case where the sound sources or the speakers are arranged in positions that differ from predetermined positions, however, sound might not be reproduced by the suggested reproduction method, or the sound quality and the sound image definition might be severely degraded though reproduction can be performed by the suggested reproduction method.

In a case where channel-based sound sources are reproduced by the above-described VBAP, most sound images of the channel-based sound sources differ in position from the ideal speakers reproducing the sound sources. As a result, the sound image definition is severely degraded.

By the above-described technology, it is difficult to realize audio reproduction with a realistic feeling.

The present technology has been developed in view of those circumstances, and aims at realizing audio reproduction with a more realistic feeling.

Solutions to Problems

An audio signal output device of a first aspect of the present technology includes: a distance calculating unit that calculates the distance between the position of an ideal speaker that reproduces an audio signal and the position of a real speaker that reproduces the audio signal; a gain calculating unit that calculates a reproduction gain of the audio signal based on the distance; and a gain adjusting unit that performs gain adjustment on the audio signal based on the reproduction gain.

The gain calculating unit can calculate the reproduction gain based on curve information for obtaining the reproduction gain corresponding to the distance.

The curve information can be information indicating a polyline curve or a function curve.

When the ideal speaker is not located on a unit circle having a predetermined reference point as the its center point, the gain adjusting unit can further perform gain adjustment on the audio signal with a gain determined based on the distance from the reference point to the ideal speaker and the radius of the unit circle.

The gain adjusting unit can delay the audio signal based on a delay time determined based on the distance from the reference point to the ideal speaker and the radius of the unit circle.

When the real speaker is not located on a unit circle having a predetermined reference point as the its center point, the gain adjusting unit can further perform gain adjustment on the audio signal with a gain determined based on the distance from the reference point to the real speaker and the radius of the unit circle.

The gain adjusting unit can delay the audio signal based on a delay time determined based on the distance from the reference point to the real speaker and the radius of the unit circle.

The audio signal output device may further include a gain correcting unit that corrects the reproduction gain based on the distance between the position of an ideal center speaker and the position of the real speaker.

The audio signal output device may further include a lower limit correcting unit that corrects the reproduction gain when the reproduction gain is smaller than a predetermined lower limit.

The audio signal output device may further include a total gain correcting unit that calculates a ratio between the total power of an output sound based on the audio signal subjected to the gain adjustment with the reproduction gain and the total power of an input sound, and corrects the reproduction gain based on the ratio, the ratio being calculated based on the reproduction gain and an expected value of the sound pressure of the input sound based on the audio signal input.

An audio signal output method or a program of the first aspect of the present technology includes the steps of: calculating the distance between the position of an ideal speaker that reproduces an audio signal and the position of a real speaker that reproduces the audio signal; calculating a reproduction gain of the audio signal based on the distance; and performing gain adjustment on the audio signal based on the reproduction gain.

In the first aspect of the present technology, the distance between the position of an ideal speaker that reproduces an audio signal and the position of a real speaker that reproduces the audio signal is calculated, a reproduction gain of the audio signal is calculated based on the distance, and gain adjustment is performed on the audio signal based on the reproduction gain.

An encoding device of a second aspect of the present technology includes: a correction information generating unit that generates correction information for correcting a gain of an audio signal in accordance with the distance between the position of an ideal speaker that reproduces the audio signal and the position of a real speaker that reproduces the audio signal; an encoding unit that encodes the audio signal; and an output unit that outputs a bit stream including the correction information and the encoded audio signal.

An encoding method of the second aspect of the present technology includes the steps of: generating correction information for correcting a gain of an audio signal in accordance with the distance between the position of an ideal speaker that reproduces the audio signal and the position of a real speaker that reproduces the audio signal; encoding the audio signal; and outputting a bit stream including the correction information and the encoded audio signal.

In the second aspect of the present technology, correction information for correcting a gain of an audio signal in accordance with the distance between the position of an ideal speaker that reproduces the audio signal and the position of a real speaker that reproduces the audio signal is generated, the audio signal is generated, and a bit stream including the correction information and the encoded audio signal is output.

A decoding device of a third aspect of the present technology includes: an extracting unit that extracts, from a bit stream, correction information for correcting a gain of an audio signal in accordance with the distance between the position of an ideal speaker that reproduces the audio signal and the position of a real speaker that reproduces the audio signal, and the encoded audio signal; a decoding unit that decodes the encoded audio signal; and an output unit that outputs the decoded audio signal and the correction information.

The correction information can be the location information about the ideal speaker.

The correction information can be curve information for obtaining the gain corresponding to the distance.

The curve information can be information indicating a polyline curve or a function curve.

A decoding method of the third aspect of the present technology includes the steps of: extracting, from a bit stream, correction information for correcting a gain of an audio signal in accordance with the distance between the position of an ideal speaker that reproduces the audio signal and the position of a real speaker that reproduces the audio signal, and the encoded audio signal; decoding the encoded audio signal; and outputting the decoded audio signal and the correction information.

In the third aspect of the present technology, correction information for correcting a gain of an audio signal in accordance with the distance between the position of an ideal speaker that reproduces the audio signal and the position of a real speaker that reproduces the audio signal, and the encoded audio signal are extracted from a bit stream, the encoded audio signal is decoded, and the decoded audio signal and the correction information are output.

Effects of the Invention

According to the first through third aspects of the present technology, audio reproduction with a more realistic feeling can be performed.

BRIEF DESCRIPTION OF DRAWINGS

FIG. 4 is a diagram for explaining reproduction gains.

FIG. 8 is a diagram for explaining metadata.

MODES FOR CARRYING OUT THE INVENTION

The following is a description of embodiments to which the present technology is applied, with reference to the drawings.

<First Embodiment>

<Outline of the Present Technology>

The present technology relates to a reproduction method of reproducing the sound source of a channel with a desired number of speakers, and techniques for encoding and decoding the necessary information (metadata) for realizing the reproduction method.

First, the outline of the present technology is described.

Audio signals of channels and the metadata of these audio signals are supplied to a reproduction device, and the reproduction device controls sound reproduction based on the metadata and the audio signals, for example.

The audio signals of the respective channels are signals generated to be reproduced through speakers placed at ideal positions indicated by the metadata. In the description below, the virtual speakers that are placed at positions indicated by the metadata and reproduce the audio signals of the respective channels will be referred to as the ideal speakers. Also, the real speakers that output sounds based on audio signals output from the reproduction device will be referred to as the reproduction speakers.

In the present technology, audio signals of all the channels are classified into audio signals for LFE (Low Frequency Effect) and audio signals not for LFE. That is, all the ideal speakers are classified into speakers for LFE and speakers not for LFE. Likewise, the reproduction speakers are classified into speakers for LFE and speakers not for LFE.

First, reproduction of audio signals of channels not for LFE is described.

Figure 1:
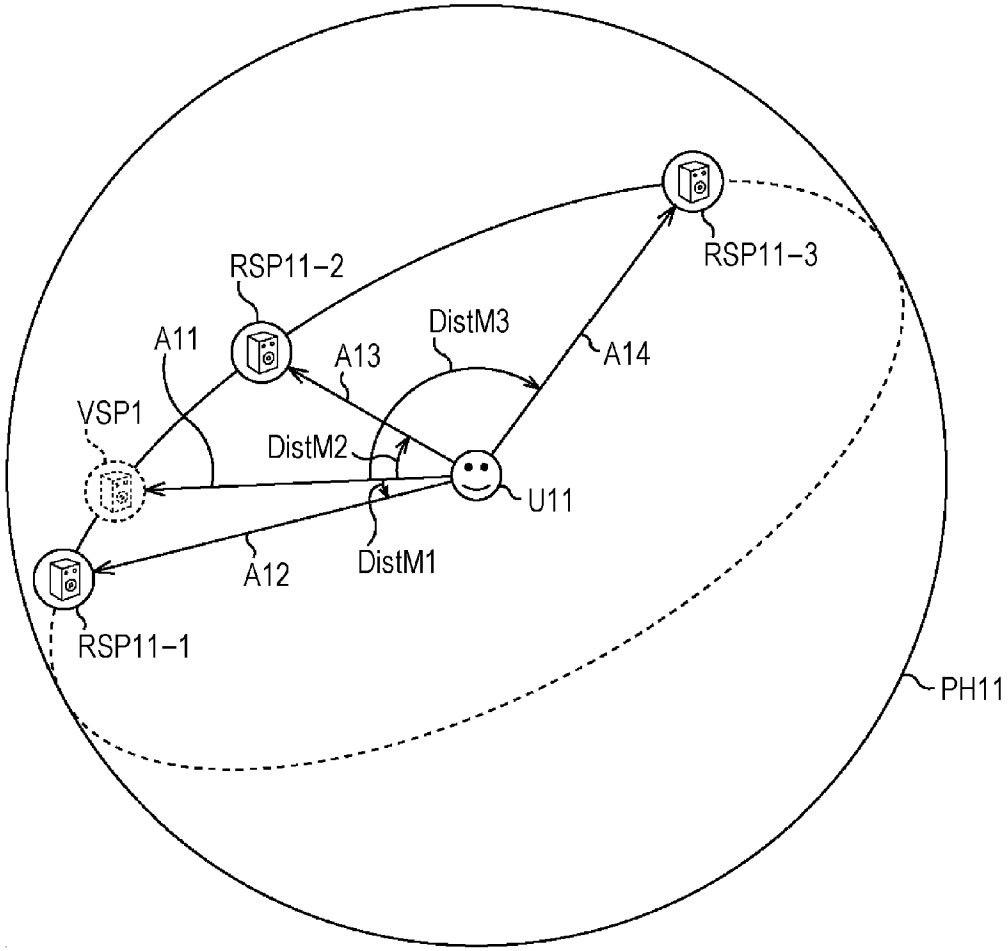
FIG. 1 is a diagram for explaining the outline of the present technology.

In reproducing audio signals of channels not for LFE, audio signal gain adjustment is performed based on the distances between an ideal speaker and reproduction speakers, as shown in FIG. 1, for example.

In FIG. 1, an ideal speaker VSP1 and reproduction speakers RSP11-1 through RSP11-3 are disposed on the surface of a sphere PH11 that has a radius $r_u$ and has its center at the position of a user U11 who is the viewer. The ideal speaker VSP1 and the reproduction speakers RSP11-1 through RSP11-3 are speakers not for LFE.

Hereinafter, the reproduction speakers RSP11-1 through RSP11-3 will be also referred to simply as the reproduction speakers RSP11, if there is no particular need to distinguish them from one another. Although only one ideal speaker and three reproduction speakers are shown in this example, other ideal speakers and reproduction speakers exist in reality.

For example, a sound based on an audio signal of the channel corresponding to the ideal speaker VSP1 ideally fixes a sound image at the position of the ideal speaker VSP1.

Therefore, in the present technology, the reproduction gains of the respective reproduction speakers RSP11 are determined in accordance with the distances between the ideal speaker VSP1 and the reproduction speakers RSP11, and a sound based on an audio signal is output from each of the reproduction speakers RSP11 with the determined reproduction gains, so that a sound image is fixed at the position of the ideal speaker VSP1.

Specifically, the distance between the ideal speaker VSP1 and a reproduction speaker RSP11 is the angle between a vector in the direction from the user U11 toward the ideal speaker VSP1 and a vector in the direction from the user U11 toward the reproduction speaker RSP11.

In other words, the distance between the ideal speaker VSP1 and a reproduction speaker RSP11 on the surface of the sphere PH11, or the length of the arc connecting the two speakers, is the distance between the ideal speaker VSP1 and the reproduction speaker RSP11.

In the example shown in FIG. 1, the angle between an arrow A11 and an arrow A12 is the distance DistM1 between the ideal speaker VSP1 and the reproduction speaker RSP11-1. Likewise, the angle between the arrow A11 and an arrow A13 is the distance DistM2 between the ideal speaker VSP1 and the reproduction speaker RSP11-2, and the angle between the arrow A11 and an arrow A14 is the distance DistM3 between the ideal speaker VSP1 and the reproduction speaker RSP11-3.

An audio signal of the channel of the ideal speaker VSP1 is subjected to gain adjustment based on the distance DistM1, and is reproduced by the reproduction speaker RSP11-1. The audio signal of the channel of the ideal speaker VSP1 is also subjected to gain adjustment based on the distance DistM2 and the distance DistM3, and is reproduced by the reproduction speaker RSP11-2 and the reproduction speaker RSP11-3.

Accordingly, even in a case where there are differences in position between the ideal speaker VSP1 and the reproduction speakers RSP11, differences caused in the sound image by the differences in position can be reduced, and audio reproduction with a more realistic feeling can be realized.

Next, reproduction of audio signals of channels not for LFE is described in greater detail.

Specifically, in the example described below, audio signals of M ideal speakers not for LFE, or of M channels, are down-mixed to generate audio signals of N channels, and the audio signals of the N channels are reproduced by N reproduction speakers not for LFE.

In the down-mixing process, the six processes STE1 through STE6 shown below are mainly performed in sequential order.

Process STE1: The distances between the ideal speakers and the reproduction speakers are determined.

Process STE2: The reproduction gains of the respective reproduction speakers are determined for each ideal speaker based on the determined distances and a predetermined attenuation curve.

Process STE3: The reproduction gains are corrected in accordance with the position of a reproduction speaker.

Process STE4: The reproduction gains are corrected based on a lower limit.

Process STE5: The reproduction gains are corrected so that the energy of the total output sound approximates the energy of the total input sound.

Process STE6: The reproduction gains are applied to audio signals, and gain adjustment is performed.

These processes STE1 through STE6 are further described below.

<Process STE1>

First, in the process STE1, the distances between speakers are determined. The position of each speaker is represented by a horizontal angle θ ($-180° \leq \theta \leq +180°$), a vertical angle γ ($-90° \leq \gamma \leq +90°$), and a distance from the user to the speaker r ($0 \leq r \leq +\infty$).

For example, FIG. 1 shows a three-dimensional coordinate system formed with the x-axis, the y-axis, and the z-axis, with the position of the user U11 being the origin.

Where the x-y plane is the plane including a straight line extending in the depth direction of the drawing and a straight line extending in the transverse direction of the drawing, the angle between a straight line extending in the reference direction in the x-y plane, or the y-axis, and the vector in the direction from the user U11 toward the speaker is the horizontal angle θ, for example. That is, the horizontal angle θ is an angle in the horizontal direction in FIG. 1.

Also, the angle between the vector in the direction from the user U11 toward the speaker and the x-y plane is the vertical angle γ, and the length of the straight line connecting the user U11 and the speaker is the distance r.

The horizontal angles θ, the vertical angles γ, and the distances r, which indicate the positions of the respective ideal speakers, are supplied as the metadata of audio signals to the reproduction device. The horizontal angles θ, the vertical angles γ, and the distances r, which indicate the positions of the respective reproduction speakers, are also supplied to the reproduction device.

In the description below, the horizontal angle θ, the vertical angle γ, and the distance r of the mth ideal speaker among the M ideal speakers will be represented by $\theta_{im}$, $\gamma_{im}$, and $r_{im}$, respectively. Likewise, the horizontal angle θ, the vertical angle γ, and the distance r of the nth reproduction speaker among the N reproduction speakers will be represented by $\theta_{on}$, $\gamma_{on}$, and $r_{on}$, respectively.

The reproduction device calculates the distances between each of M ideal speakers and the N reproduction speakers.

For example, the distance Dist(m, n) between the mth ideal speaker and the nth reproduction speaker is calculated according to the equation (1) shown below.

[Mathematical Formula 1]

$$\mathrm{Dist}(m,n)=\arccos\left[\cos\theta_{im}\times\cos\theta_{on}\times\cos(\gamma_{im}-\gamma_{on})+\sin\theta_{im}\times\sin\theta_{on}\right] \quad (1)$$

The reproduction device performs calculation according to the equation (1) for each of the combinations of the M ideal speakers and the N reproduction speakers, and calculates a total of (M×N) distances Dist(m, n).

If the respective ideal speakers and the respective reproduction speakers are located on a unit circle having the radius $r_u$ or on the sphere PH11 shown in FIG. 1, sounds output from the respective speakers reach the user U11 at the same time. If one of the speakers is not located on the sphere PH11, however, the sound from the speaker reaches the user U11 earlier or later than the sounds from the other speakers, and furthermore, a change is caused in the sound pressure of the sound to be heard by the user.

Therefore, the reproduction device performs sound pressure correction using a correction value $\mathrm{SoundPressureCorrection}_{im}$ on the audio signal of the ideal speaker having a distance $r_{im}$ not equal to $r_u$, and performs a delay process using a delay time $\mathrm{Delay}_{im}$.

In this manner, the ideal speaker can be regarded as being located on the sphere PH11.

Specifically, calculation according to the equation (2) shown below is performed based on the distance $r_{im}$ and the radius $r_u$, so that the correction value $\mathrm{SoundPressureCorrection}_{im}$ is obtained.

[Mathematical Formula 2]

$$SoundPressureCorrection_{im} = -10\times\log_{10}\left[\left(\frac{r_{im}}{r_u}\right)^2\right]\ (\mathrm{dB}) \quad (2)$$

The correction value $\mathrm{SoundPressureCorrection}_{im}$ determined according to the equation (2) is used in the correction to be performed on the audio signal of the ideal speaker side or on the audio signal of the channel m that is input to the reproduction device. In the description below, an audio signal that is input to the reproduction device will be also referred to as an input audio signal, and an audio signal that is output from the reproduction device will be also referred to as an output audio signal.

The delay time $\mathrm{Delay}_{im}$ for the delay process to be performed on the input audio signal of the ideal speaker is calculated according to the equation (3) shown below based on the distance $r_{im}$ and the radius $r_u$. If $r_{im}>r_u$, the delay time $\mathrm{Delay}_{im}$ has a negative value, and, in the delay process, the audio signal is delayed in the negative direction, or the audio signal is shifted backward in terms of time.

[Mathematical Formula 3]

$$\mathrm{Delay}_{im}=(r_u-r_{im})\times\text{sound speed }(s) \quad (3)$$

The correction value $\mathrm{SoundPressureCorrection}_{im}$ and the delay time $\mathrm{Delay}_{im}$ are calculated for each ideal speaker having a distance $r_{im}$ not equal to $r_u$. Likewise, the correction value $\mathrm{SoundPressureCorrection}_{on}$ and the delay time $\mathrm{Delay}_{on}$, are also calculated for each reproduction speaker having a distance $r_{on}$ not equal to $r_u$.

Specifically, the correction value $\mathrm{SoundPressureCorrection}_{on}$ is calculated according to the equation (4) shown below, and the delay time $\mathrm{Delay}_{on}$ is calculated according to the equation (5) shown below.

[Mathematical Formula 4]

$$SoundPressureCorrection_{on} = -10\times\log_{10}\left[\left(\frac{r_{on}}{r_u}\right)^2\right]\ (\mathrm{dB}) \quad (4)$$

[Mathematical Formula 5]

$$Delay_{on} = (r_u - r_{on})\times\text{sound speed }(s) \quad (5)$$

The correction value $\mathrm{SoundPressureCorrection}_{on}$ and the delay time $\mathrm{Delay}_{on}$ calculated in the above manner are the sound pressure correction value and the delay time for the reproduction speaker side or an output audio signal. Therefore, the reproduction device performs sound pressure correction using the correction value $\mathrm{SoundPressureCorrection}_{on}$ on the audio signal supplied to a reproduction speaker having a distance $r_{on}$ not equal to $r_u$, and performs a delay process using the delay time $\mathrm{Delay}_{on}$.

<Process STE2>

In the process STE2, the reproduction gains of the respective reproduction speakers are calculated with respect to each ideal speaker.

First, for each of the M ideal speakers, a check is made to determine whether there is a reproduction speaker at a distance Dist(m, n) of "0" from the ideal speaker. The respective ideal speakers are then classified into speakers located in reproduction speaker positions and speakers not located in reproduction speaker positions.

For the mth ideal speaker determined to be a speaker located in a reproduction speaker position, the reproduction gain MixGain(m, n) of the nth reproduction speaker with respect to the audio signal of the channel m corresponding to the mth ideal speaker is calculated according to the equation (6) shown below.

[Mathematical Formula 6]

$$MixGain(m,n) = \begin{cases} 0\ \mathrm{dB} & Dist(m,n)=0 \\ -\infty\ \mathrm{dB}, & Dist(m,n)>0 \end{cases} \quad (6)$$

According to the equation (6), the reproduction gain MixGain(m, n) of a reproduction speaker at a distance Dist(m, n) of "0" or a reproduction speaker located in the same position as the mth ideal speaker is 0 dB. Also, the reproduction gain MixGain(m, n) of a reproduction speaker at a distance Dist(m, n) that is not "0" or a reproduction speaker located in a different position from that of the mth ideal speaker is −∞ dB.

Accordingly, the audio signal of the channel m corresponding to the mth ideal speaker is reproduced by the reproduction speaker located in the same position as the ideal speaker. That is, any sound component of the channel m is not output from the other reproduction speakers.

For the mth ideal speaker determined to be a speaker not located in a reproduction speaker position, on the other hand, the reproduction gain MixGain(m, n) of each reproduction speaker with respect to the ideal speaker is calculated with the use of an attenuation curve that is a polyline curve or a function curve.

Specifically, the metadata to be supplied to the reproduction device includes curve information indicating which one of a polyline curve and a function curve is to be used in calculating a reproduction gain, and the reproduction device calculates a reproduction gain using the curve of the type indicated by the curve information included in the metadata.

The metadata also includes a curve index specifically indicating which one of the curves indicated in the curve information is to be used. The curve index might be information indicating a new curve that is not recorded in the reproduction device.

In a case where the curve index is information indicating a predetermined curve, the reproduction device calculates a reproduction gain, using information that is recorded in advance and is designed for obtaining a curve such as coefficients. In a case where the curve index is information indicating a new curve, on the other hand, the reproduction device reads information for obtaining a new curve from the metadata, and calculates a reproduction gain, using the curve obtained from the information.

For example, the polyline curve to be used in calculating a reproduction gain is expressed as a numerical sequence formed with the values of the reproduction gains corresponding to the respective distances Dist(m, n).

Specifically, as the numerical sequence formed with the values of reproduction gains, [0, −1.5, −4.5, −6, −9, −10.5, −12, −13.5, −15, −15, −16.5, −16.5, −18, −18, −18, −19.5, −19.5, −21, −21, −21, −∞, −∞, −∞, −∞, −∞, −∞] (dB) is the information for obtaining a reproduction gain.

In such a case, the value at the start of the numerical sequence is the reproduction gain at the time when the distance Dist(m, n) is 0 degrees, and the value at the end of the numerical sequence is the reproduction gain at the time when the distance Dist(m, n) is 180 degrees. Also, the value at the kth point in the numerical sequence is the reproduction gain at the time when the distance Dist(m, n) is as expressed by the equation (7) shown below.

[Mathematical Formula 7]

$$Dist(m, n) = (k-1) \times \frac{180^\circ}{\text{Length of numerical sequence} - 1} \tag{7}$$

Between adjacent points in the numerical sequence, the reproduction gain linearly varies depending on the distance Dist(m, n). The polyline curve obtained with such a numerical sequence is the curve representing the mapping of the reproduction gain MixGain(m, n) and the distance Dist(m, n).

Figure 2:
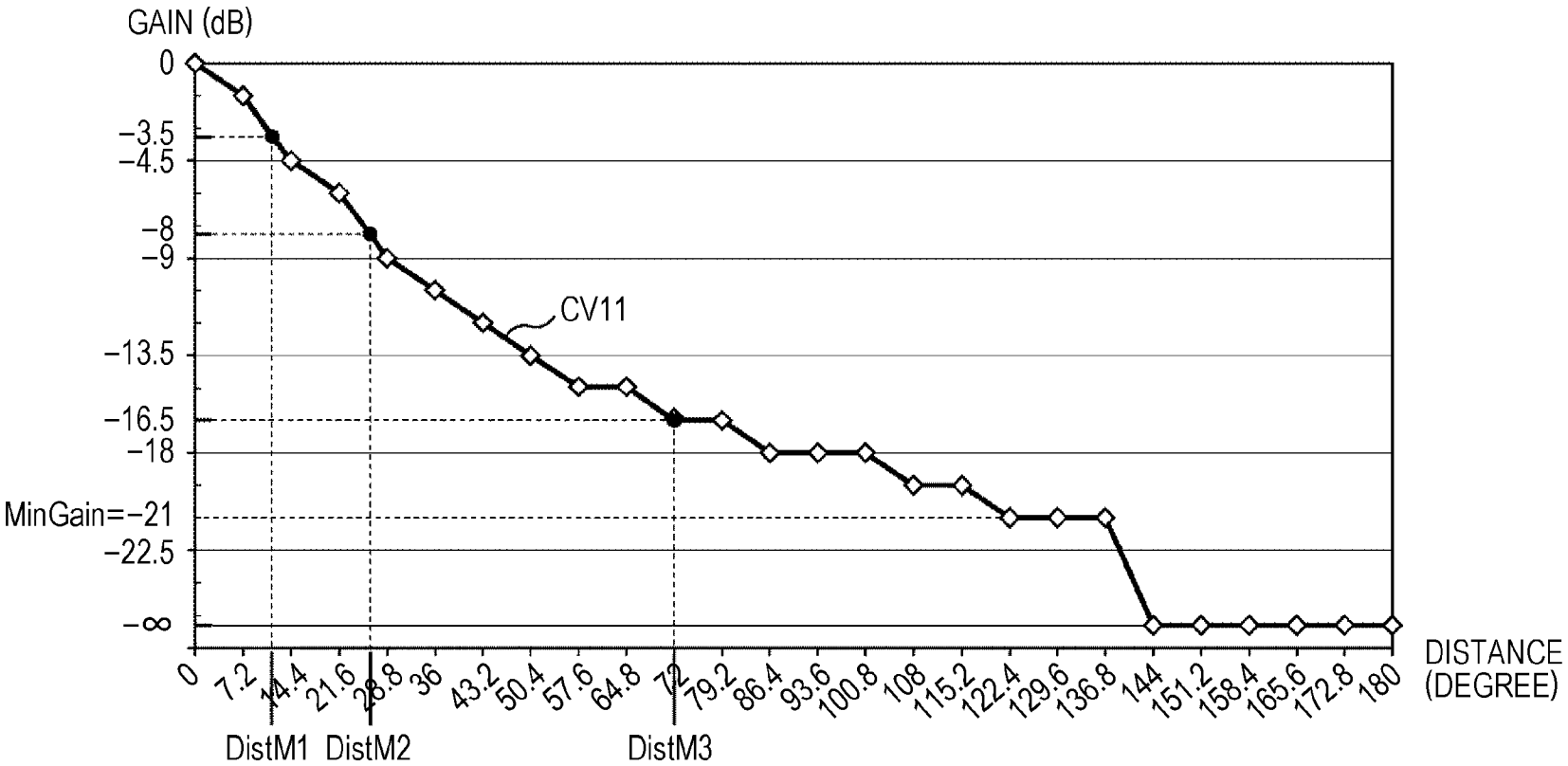
FIG. 2 is a diagram for explaining a polyline curve.

For example, the polyline curve shown in FIG. 2 is obtained from the above-described numerical sequence.

In FIG. 2, the ordinate axis indicates the value of the reproduction gain, and the abscissa axis indicates the distance between an ideal speaker and a reproduction speaker. Also, a polyline CV11 represents the polyline curve, and each square on the polyline curve represents a numerical value of the numerical sequence formed with the values of the reproduction gain.

In this example, when the distance Dist(m, n) between the nth reproduction speaker and the mth ideal speaker is DistM1, the reproduction gain MixGain(m, n) of the nth reproduction speaker is −3.5 dB, which is the value of the gain at DistM1 on the polyline curve.

Also, the reproduction gain MixGain(m, n) of the reproduction speaker at a distance Dist(m, n) of DistM2 is −8 dB, which is the value of the gain at DistM2 on the polyline curve, and the reproduction gain MixGain(m, n) of the reproduction speaker at a distance Dist(m, n) of DistM3 is −16.5 dB, which is the value of the gain at DistM3 on the polyline curve.

Meanwhile, the function curve to be used in calculating a reproduction gain is expressed with three coefficients coef1, coef2, and coef3, and a gain value MinGain, which is a predetermined lower limit.

In this case, the reproduction device performs calculation according to the equation (9) shown below, using the function f(Dist(m, n)) shown in the equation (8) expressed with the coefficients coef1 through coef3, the gain value MinGain, and the distance Dist(m, n). By doing so, the reproduction device calculates the reproduction gain MixGain(m, n) of each reproduction speaker with respect to the mth ideal speaker.

[Mathematical Formula 8]

$$f(Dist(m, n)) = MinGain \times \left( Coef1 \times \left(\frac{Dist(m, n)}{180^\circ}\right)^3 + Coef2 \times \left(\frac{Dist(m, n)}{180^\circ}\right)^2 + Coef3 \times \left(\frac{Dist(m, n)}{180^\circ}\right) \right) \tag{8}$$

[Mathematical Formula 9]

$$MixGain(m, n) = \begin{cases} 0 \text{ dB}, & f(Dist(m, n)) > 0 \text{ dB} \\ f(Dist(m, n)), & \text{otherwise} \\ -\infty \text{ dB}, & Dist(m, n) > \text{Cut_thre} \end{cases} \tag{9}$$

In the equation (9), Cut_thre represents the smallest value that satisfies the equation (10) shown below.

[Mathematical Formula 10]

$$f(\text{Cut_thre}) = \text{MinGain} = -21 \text{ dB}, f'(\text{Cut_thre}) < 0 \tag{10}$$

Figure 3:
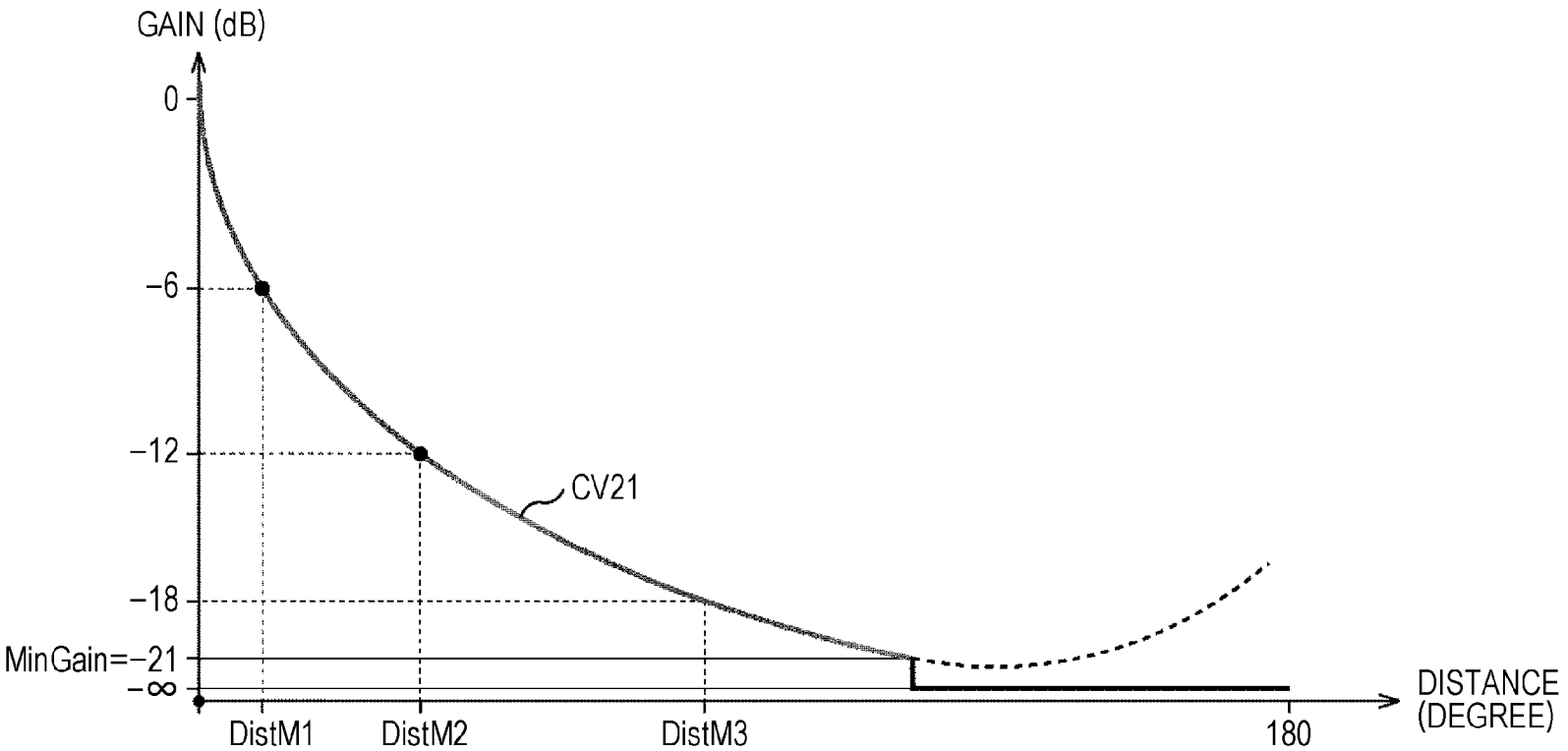
FIG. 3 is a diagram for explaining a function curve.

The function curve expressed with such a function f(Dist(m, n)) and the like is the curve shown in FIG. 3, for example. In FIG. 3, the ordinate axis indicates the value of the reproduction gain, and the abscissa axis indicates the distance between an ideal speaker and a reproduction speaker. A curve CV 21 represents the function curve.

According to the function curve shown in FIG. 3, after the value of the reproduction gain indicated by the function f(Dist(m, n)) becomes smaller than the gain value MinGain, which is the lower limit, the value of the reproduction gain at each distance Dist(m, n) is "−∞". The dashed line in the drawing represents the values of the original function f(Dist(m, n)) at the respective distances Dist(m, n).

In this example, when the distance Dist(m, n) between the nth reproduction speaker and the mth ideal speaker is DistM1, the reproduction gain MixGain(m, n) of the nth reproduction speaker is −6 dB, which is the value of the gain at DistM1 on the function curve.

Also, the reproduction gain MixGain(m, n) of the reproduction speaker at the distance Dist(m, n) of DistM2 is −12 dB, which is the value of the gain at DistM2 on the function curve, and the reproduction gain MixGain(m, n) of the reproduction speaker at the distance Dist(m, n) of DistM3 is −18 dB, which is the value of the gain at DistM3 on the function curve.

In a case where the reproduction gain MixGain(m, n) is calculated from the function curve, the combination [coef1, coef2, coef3] of the coefficients coef1 through coef3 may be [8, −12, 6], [1, −3, 3], or [2, −5.3, 4.2], for example.

Through the above process, the reproduction gains MixGain(m, n) of the N reproduction speakers are obtained for each of the M ideal speakers. The values of the reproduction gains of these reproduction speakers are greater where the distance Dist(m, n) to the ideal speaker is shorter. The same applies to the volumes of sounds from these reproduction speakers. Where M>N, the reproduction gains MixGain(m, n) are mix gains.

<Process STE3>

Further, in the process STE3, the (M×N) reproduction gains MixGain(m, n) obtained in the process STE2 are corrected in accordance with the position of the nth reproduction speaker.

For example, if a sound from a sound source located in front of a user comes from behind the user, the user will find it strange. If a sound from a sound source located behind the user comes from ahead of the user, the user will not find it very strange.

Therefore, the reproduction gains of the respective reproduction speakers are corrected in accordance with the positions of the N reproduction speakers located in front of or behind the user, so that the output sounds will not cause a feeling of strangeness depending on the positions of the reproduction speakers. That is, in a case where an audio signal of an ideal speaker is reproduced by two reproduction speakers that are at the same distance Dist(m, n) from the ideal speaker and are located in front of the user and behind the user, correction is performed so that the reproduction gain of the reproduction speaker behind the user becomes smaller than the reproduction gain of the reproduction speaker in front of the user.

Specifically, the reproduction device first obtains information indicating whether it is necessary to correct reproduction gains in accordance with the positions of reproduction speakers from the metadata. If the obtained information indicates that there is no need to correct reproduction gains, the process STE3 is not carried out. That is, after the process STE2, the process STE3 is skipped, and the process STE4 is carried out.

If the information obtained from the metadata indicates that it is necessary to correct reproduction gains, on the other hand, the reproduction device performs the same calculation as the equation (1), and determines the distances Dist(n, C) between a spatial origin C and the N reproduction speakers.

Here, the spatial origin C is the reference position in the space in which the reproduction speakers are placed, and the position of the spatial origin C is expressed with a horizontal angle θ of 0, a vertical angle γ of 0, and a distance r equal to $r_u$, for example. In this case, the spatial origin C is located on the unit circle or on the sphere PH11 shown in FIG. 1, and is located in front of the user U11. The position of such a spatial origin C is the position of an ideal center speaker.

After the distances Dist(n, C) from the spatial origin C to the N reproduction speakers are determined, the correction coefficient spkr_pos_correction_coeffcient(n) of each of the N reproduction speakers is determined through calculation according to the equation (11) shown below.

[Mathematical Formula 11]

$$\text{spkr_pos_correction_coeffcient}(n) = \text{Max_spkr_pos_correction_coeffcient} \times \frac{Dist(n, c)}{180^\circ} \tag{11}$$

In the equation (11), Max_spkr_pos_correction_coeffcient represents the correction coefficient at the time when the distance Dist(n, C) is maximized (180 degrees).

Further, the reproduction gain MixGain(m, n) of the nth reproduction speaker with respect to the mth ideal speaker is multiplied by the obtained correction coefficient spkr_pos_correction_coeffcient(n), so that a corrected reproduction gain MixGain_pos_corr(m, n) is obtained. That is, calculation is performed according to the equation (12) shown below.

[Mathematical Formula 12]

$$\text{MixGain_pos_corr}(m, n) = MixGain(m, n) \times \text{spkr_pos_correction_coeffcient}(n) - MaxMixGain(n) \times (\text{Max_spkr_pos_correction_coeffcient} - 1) \times \frac{Dist(n, c)}{180^\circ} \tag{12}$$

In the equation (12), MaxMixGain(n) represents the largest value of M reproduction gains of the nth reproduction speaker or the reproduction gains MixGain(m, n) having the same value as n. In the equation (12), the term including MaxMixGain(n) is the term of reverse correction for preventing excess correction from being performed with spkr_pos_correction coeffcient(n).

Through the above process, (M×N) reproduction gains MixGain_pos_corr(m, n), which have been appropriately corrected in accordance with the positions of the reproduction speakers, are obtained.

In a case where reproduction gain correction in accordance with the positions of the reproduction speakers is not performed, the reproduction gains MixGain(m, n) are used as the reproduction gains MixGain_pos_corr(m, n).

<Process STE4>

In the process STE4 to be carried out after the process STE3, the reproduction gains are corrected so that audio signals are reproduced by at least one reproduction speaker with a predetermined lower limit of reproduction gain. Here, the audio signals are of an ideal speaker with which all the reproduction speakers have small reproduction gain values.

Specifically, the largest value $MaxMixGain_1(m)$ of the reproduction gains of each ideal speaker obtained in the process STE3 or the N reproduction gains MixGain_pos_corr(m, n) having the same value as m is determined, and the largest value $MaxMixGain_i(m)$ is compared with a lower limit $MixGain_{MinThre}$.

If the largest value $MaxMixGain_i(m)$ with respect to the predetermined mth ideal speaker is smaller than the lower limit $MixGain_{MinTnre}$, a correction value $MinGain_{correctioni}(m)$ is added to the N reproduction gains MixGain_pos_corr(m, n) with respect to the mth ideal speaker. Here, the correction value $MinGain_{correctioni}(m)$ the difference between the largest value $MaxMixGain_1(m)$ and the lower limit $MixGain_{MinTnre}$, as shown in the equation (13) shown below.

[Mathematical Formula 13]

$$MinGain_{correctioni}(m) = MaxMixGain_i(m) - MixGain_{MinThre} \tag{13}$$

Through this correction, the audio signal of the channel m is reproduced by at least one reproduction speaker with the predetermined smallest reproduction gain, and the sound from a certain channel can be prevented from becoming inaudible.

<Process STE5>

In the process STE5, the reproduction gains MixGain_pos_corr(m, n) are corrected so that the energy of the total output sound approximates the energy of the total input sound.

First, the reproduction device reads expected values SPR_i(m) of the relative sound pressures between the respective channels of the ideal speakers from the metadata, and assumes the absolute sound pressure of the ideal speaker having the highest sound pressure to be 0 dBFS. The reproduction device then calculates the sound pressures of the sounds of the audio signals of the respective channels from the expected values SPR_i(m) of the respective ideal speakers, and determines the power value pow_i of the total sound of the input audio signals.

Here, the power value pow_i is the power of the total sound that is output from the ideal speakers as a result of reproduction of the audio signals of the M channels (the total sound output from the ideal speakers will be hereinafter also referred to as the input sound). Also, the sound that is output from the reproduction speakers as a result of reproduction of the audio signals of the N channels will be hereinafter also referred to as the output sound.

The reproduction device then multiplies the reproduction gains MixGain_pos_corr(m, n) obtained in the process STE4 by the expected values SPR_i(m), to determine the expected values SPR_o(n) of the sound pressures of the output sounds from the respective reproduction speakers. The reproduction device then determines the power value pow_o of the total output sound from the expected values SPR_o(n)

The reproduction device then multiplies all the reproduction gains MixGain_pos_corr(m, n) obtained in the process STE4 by the power value ratio between the input sound and the output sound (pow_o/pow_i), to correct the sound pressure of the total output sound. The reproduction gains obtained in this manner are the ultimate reproduction gains of the reproduction speakers with respect to each ideal speaker.

In this example, the absolute sound pressure of the ideal speaker having the highest sound pressure is assumed to be 0 dB, and the power value ratio between the input sound and the output sound (pow_o/pow_i) is then determined. The determined power value ratio is the same as the power value ratio between the input sound and the output sound (pow_o/pow_i) determined with the use of the actual absolute sound pressure. Even in a case where the absolute sound pressure of the actual input sound is unknown, if the absolute sound pressure of the input sound is assumed in the above manner, the power value ratio between the input sound and the output sound (pow_o/pow_i) can be determined. The assumed sound pressure value may not be 0 dB but may be some other value, to obtain the same power value ratio as above.

<Speakers for LFE>

Reproduction of audio signals of channels for LFE is described.

For example, the number of ideal speakers for LFE is zero, one, or two. Likewise, the number of reproduction speakers for LFE is zero, one, or two.

In a case where the number of ideal speakers for LFE or the number of reproduction speakers for LFE is zero, the audio signal of any channel for LFE cannot be reproduced, and the gain of the audio signal is $-\infty$.

In a case where the number of ideal speakers for LFE and the number of reproduction speakers for LFE are one or two, on the other hand, the reproduction device generates the audio signal of each channel for LFE with the reproduction gains shown in FIG. 4, for example.

That is, in a case where both the number of ideal speakers for LFE and the number of reproduction speakers for LFE are one or two, the audio signal(s) of the ideal speaker(s) for LFE are reproduced as the audio signal(s) of the reproduction speaker(s) for LFE.

In a case where there are one ideal speaker for LFE and two reproduction speakers for LFE, or where there are two ideal speakers for LFE and one reproduction speaker for LFE, the audio signals of the respective channels are evenly distributed.

That is, in a case where two reproduction speakers for LFE are provided for one ideal speaker for LFE, the audio signal of the ideal speaker is subjected to gain adjustment with the same reproduction gain, and is reproduced by the two reproduction speakers. In a case where one reproduction speaker for LFE is provided for two ideal speakers for LFE, the audio signals of the ideal speakers are combined into one audio signal with the same reproduction gain, and the audio signal is reproduced by the reproduction speaker.

<Example Structure of the Reproduction Device>

Next, a specific embodiment of the reproduction device described above is described.

Figure 5:
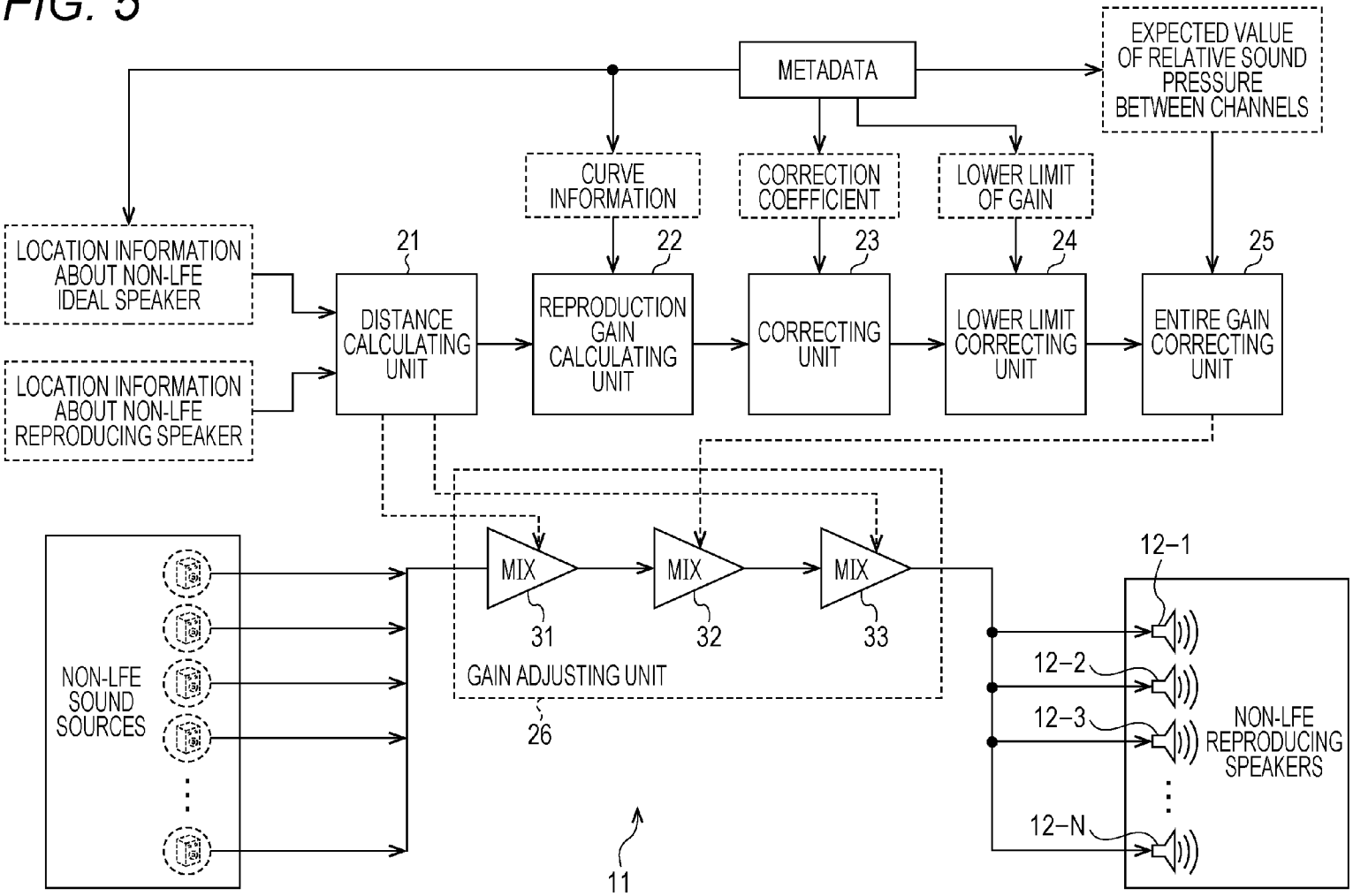
FIG. 5 is a diagram showing an example structure of a reproduction device.

The reproduction device has the structure shown in FIG. 5, for example.

The reproduction device 11 shown in FIG. 5 receives metadata and an audio signal from a decoder or the like (not shown), performs gain adjustment on the audio signal based on the metadata, and supplies the resultant audio signal to speakers 12-1 through 12-N.

FIG. 5 shows only the functional blocks of the reproduction device 11 for reproducing audio signals of channels not for LFE, and does not show the functional blocks for reproducing audio signals of channels for LFE.

In FIG. 5, audio signals of M channels are supplied to the corresponding M ideal speakers not for LFE. The audio signals of the M channels are converted into audio signals of N channels, and are then output. Further, the speakers 12-1 through 12-N correspond to the above described reproduction speakers not for LFE.

Hereinafter, when there is no particular need to distinguish the speakers 12-1 through 12-N from one another, the speakers 12-1 through 12-N will be also referred to simply as the speakers 12. The respective speakers 12 are also the speakers corresponding to the above-described reproduction speakers RSP11, and therefore, the speakers 12 will be also referred to as the reproduction speakers 12.

The reproduction device 11 shown in FIG. 5 includes a distance calculating unit 21, a reproduction gain calculating unit 22, a correcting unit 23, a lower limit correcting unit 24, a total gain correcting unit 25, and a gain adjusting unit 26. The gain adjusting unit 26 includes an amplifier 31, an amplifier 32, and an amplifier 33.

The location information about the respective ideal speakers not for LFE and the location information about the respective reproduction speakers 12, which are included in the metadata, are supplied to the distance calculating unit 21. The distance calculating unit 21 calculates distances Dist(m, n) based on the location information about the ideal speaker and the location information about the reproduction speakers 12, and supplies the distances Dist(m, n) to the reproduction gain calculating unit 22.

Here, the location information about each speaker is information formed with a horizontal angle $\theta$, a vertical angle $\gamma$, and a distance r.

The distance calculating unit 21 calculates correction values $SoundPressureCorrection_{im}$ and delay times $Delay_{im}$ of the ideal speaker side, and supplies the correction values and the delay times to the amplifier 31, as necessary. The distance calculating unit 21 also calculates correction values $SoundPressureCorrection_{on}$ and delay times $Delay_{on}$ of the side of the reproduction speakers 12, and supplies the correction values and the delay times to the amplifier 33. That is, the process STE1 is performed in the distance calculating unit 21.

The curve information and the curve index included in the metadata are supplied to the reproduction gain calculating unit 22. The reproduction gain calculating unit 22 calculates reproduction gains MixGain(m, n) using the curve information and the curve index as well as the distances supplied from the distance calculating unit 21, and supplies the reproduction gains MixGain(m, n) to the correcting unit 23. That is, the process STE2 is performed in the reproduction gain calculating unit 22.

The location information about the reproduction speakers 12, the information that is included in the metadata and indicates whether it is necessary to correct the reproduction gains in accordance with the positions of the reproduction speakers 12, and the correction coefficient Max_spkr_pos_correction coeffcient are supplied to the correcting unit 23.

Based on the supplied information, the correcting unit 23 corrects the reproduction gains supplied from the reproduction gain calculating unit 22 in accordance with the positions of the reproduction speakers 12, and supplies the resultant reproduction gains MixGain_pos_corr(m, n) to the lower limit correcting unit 24. That is, the process STE3 is performed in the correcting unit 23.

The reproduction gain lower limit $MixGain_{MinThre}$ included in the metadata is supplied to the lower limit correcting unit 24. Based on the lower limit $MixGain_{MinThre}$ the lower limit correcting unit 24 corrects the reproduction gains supplied from the correcting unit 23, and supplies the corrected reproduction gains to the total gain correcting unit 25. That is, the process STE4 is performed in the lower limit correcting unit 24.

The expected values SPR_i(m) that are included in the metadata and are of the relative sound pressures between the respective channels of the ideal speakers are supplied to the total gain correcting unit 25. Based on the expected values SPR_i(m), the total gain correcting unit 25 corrects the reproduction gains supplied from the lower limit correcting unit 24, and supplies the resultant ultimate reproduction gains to the amplifier 32. The process STE5 is performed in the total gain correcting unit 25.

The gain adjusting unit 26 generates the audio signals of the N channels by performing gain adjustment on the audio signals of the M ideal speakers supplied from the decoder (not shown), and supplies the audio signals of the respective channels to the reproduction speakers 12 for reproduction. The process STE6 is performed in the gain adjusting unit 26.

That is, based on the correction values and the delay times supplied from the distance calculating unit 21, the amplifier 31 performs gain correction and a delay process on the supplied audio signals of the M channels as appropriate, and supplies the resultant audio signals to the amplifier 32.

The amplifier 32 multiplies the audio signals of the M channels supplied from the amplifier 31 by the reproduction gains supplied from the total gain correcting unit 25. The amplifier 32 also generates the audio signals of the N channels by adding the audio signals of the respective ideal speakers multiplied by the reproduction gains, and supplies the generated audio signals to the amplifier 33.

Based on the correction values and the delay times supplied from the distance calculating unit 21, the amplifier 33 performs gain correction and a delay process on the audio signals of the N channels supplied from the amplifier 32 as appropriate, and supplies the resultant audio signals to the reproduction speakers 12.

<Explanation of the Down-Mixing Process>

Next, the operation of the reproduction device 11 is described.

When the audio signals and the metadata of the respective ideal speakers are supplied to the reproduction device 11, the reproduction device 11 generates the audio signals to be supplied to the reproduction speakers with respect to audio signals for LFE and audio signals not for LFE, and then outputs the generated audio signals.

Figure 6:
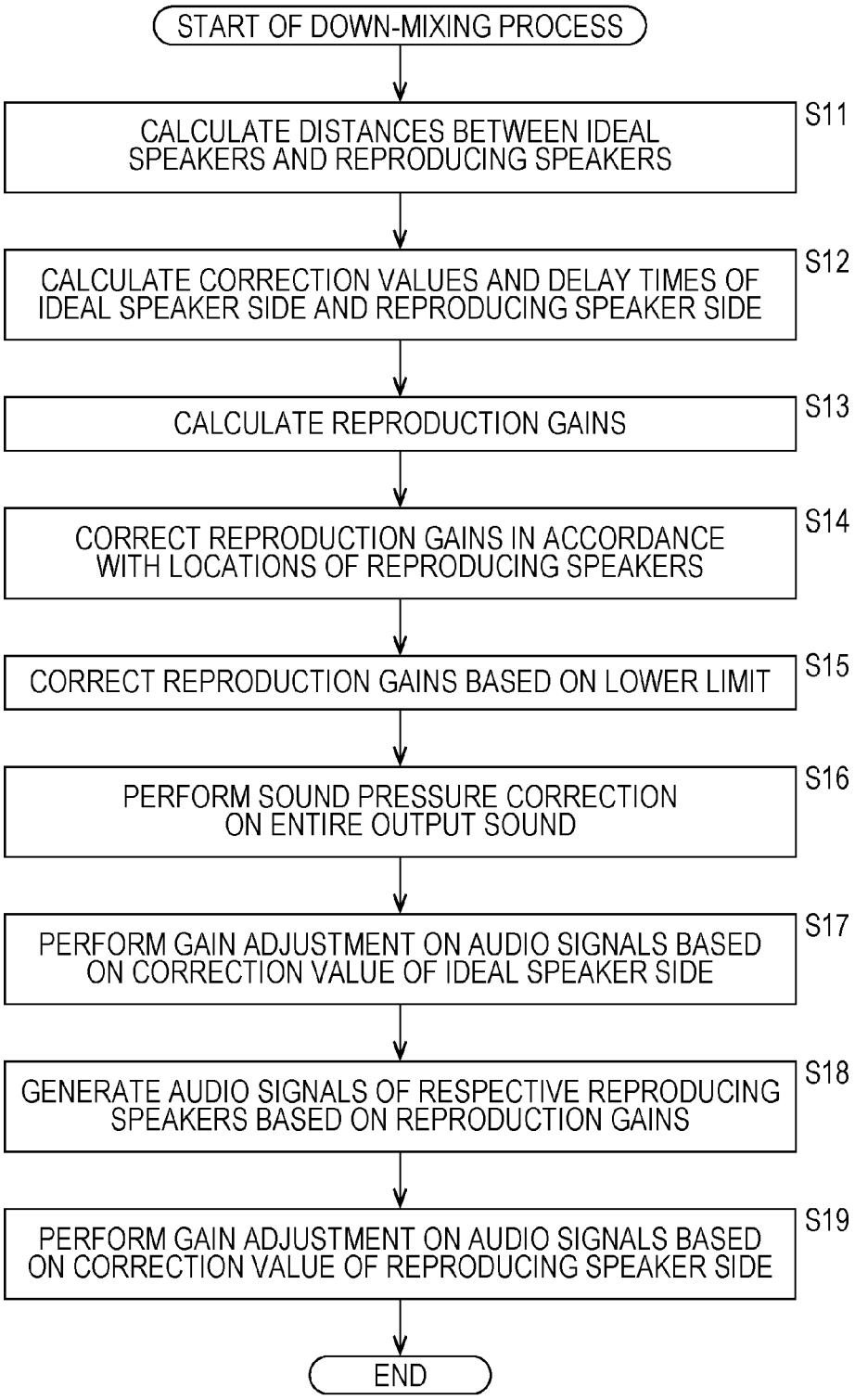
FIG. 6 is a flowchart for explaining a down-mixing process.

Referring to the flowchart in FIG. 6, the down-mixing process to be performed by the reproduction device 11 on the audio signals not for LFE is described below.

In step S11, the distance calculating unit 21 determines the distances Dist(m, n) between the ideal speakers and the reproduction speakers 12 based on the location information about the ideal speakers not for LFE and the location information about the reproduction speakers 12 not for LFE, which are included in the metadata, and supplies the distances Dist(m, n) to the reproduction gain calculating unit 22. Specifically, the calculation according to the equation (1) is performed for each of the combinations of the ideal speakers and the reproduction speakers 12, to determine (M×N) distances Dist(m, n).

In step S12, the distance calculating unit 21 determines the correction values and the delay times of the ideal speaker side and the side of the reproduction speakers 12, as necessary.

Specifically, for the ideal speakers each having a distance $r_{im}$ not equal to $r_u$, the distance calculating unit 21 calculates the correction values $SoundPressureCorrection_{im}$ and the delay times $Delay_{im}$ by performing the calculation according to the equation (2) and the equation (3) based on the distances $r_{im}$ serving as the location information about the ideal speakers, and supplies the correction values and the delay times to the amplifier 31.

For the reproduction speakers each having a distance $r_{on}$ not equal to $r_u$, the distance calculating unit 21 also calculates the correction values $SoundPressureCorrection_{on}$ and the delay times $Delay_{on}$ by performing the calculation according to the equation (4) and the equation (5) based on the distances $r_{on}$ serving as the location information about the reproduction speakers 12, and supplies the correction values and the delay times to the amplifier 33.

In step S13, the reproduction gain calculating unit 22 determines the reproduction gains of the respective reproduction speakers 12 for each ideal speaker based on the distances Dist(m, n) supplied from the distance calculating unit 21.

For example, for an ideal speaker having a reproduction speaker 12 at a distance Dist(m, n) of "0" between the ideal speaker and the reproduction speaker 12, the reproduction gain calculating unit 22 performs the calculation according to the equation (6), to calculate the reproduction gains MixGain(m, n) of the respective reproduction speakers 12 with respect to the ideal speaker.

For an ideal speaker having no reproduction speakers 12 at the distance Dist(m, n) of "0", the reproduction gain calculating unit 22 obtains the curve indicated by the curve information included in the metadata, which is a polyline curve or a function curve. In doing so, the reproduction gain calculating unit 22 refers to the curve index, and reads the polyline curve or the function curve from the metadata, as necessary.

Having obtained the polyline curve or the function curve, the reproduction gain calculating unit 22 determines the gain values corresponding to the distances Dist(m, n) based on the obtained curve, and sets the determined gain values as the reproduction gains MixGain(m, n) of the reproduction speaker 12 with respect to the ideal speaker. At this point, the calculation according to the equation (7) and the equation (9) is performed, as necessary.

Having obtained the reproduction gains MixGain(m, n) of the respective reproduction speakers 12 for each ideal speaker, the reproduction gain calculating unit 22 supplies the reproduction gains MixGain(m, n) to the correcting unit 23.

In step S14, based on the information that is included in the metadata and indicates whether it is necessary to correct the reproduction gains, the correcting unit 23 corrects the reproduction gains supplied from the reproduction gain calculating unit 22 in accordance with the positions of the reproduction speakers 12, as necessary, and supplies the corrected reproduction gains to the lower limit correcting unit 24.

Specifically, the correcting unit 23 calculates the reproduction gains MixGain_pos_corr(m, n) by performing the calculation according to the equation (11) and the equation (12) using the location information about the respective reproduction speakers 12 and the correction coefficient Max_spkr_pos_correction coeffcient included in the metadata.

In step S15, based on the lower limit $MixGain_{minThre}$ included in the metadata, the lower limit correcting unit 24 corrects the reproduction gains supplied from the correcting unit 23, as necessary, and supplies the corrected reproduction gains to the total gain correcting unit 25. Specifically, the calculation according to the equation (13) is performed as necessary, and the correction value $MinGain_{correctioni}$ (n) is added to the reproduction gains MixGain_pos_corr(m, n).

In step S16, the total gain correcting unit 25 performs sound pressure correction on the total output sound.

That is, the total gain correcting unit 25 calculates the power value ratio between the input sound and the output sound (pow_o/pow_i) based on the expected values SPR_i (m) included in the metadata and the reproduction gains MixGain_pos_corr(m, n) supplied from the lower limit correcting unit 24. The total gain correcting unit 25 then multiplies the reproduction gains MixGain_pos_corr(m, n) by the power value ratio (pow_o/pow_i) to obtain the ultimate reproduction gains, and supplies the ultimate reproduction gains to the amplifier 32.

In step S17, the amplifier 31 performs audio signal gain adjustment based on the correction values and delay values of the ideal speaker side supplied from the distance calculating unit 21.

Specifically, as for the audio signal of a channel m for which a correction value and a delay value have been supplied, the amplifier 31 multiplies the audio signal by the correction value $SoundPressureCorrection_{im}$, delays the resultant audio signal by the delay time $Delay_{im}$ in the temporal direction, and supplies the delayed audio signal to the amplifier 32.

In step S18, the amplifier 32 generates the audio signals of the respective reproduction speakers 12 based on the reproduction gains supplied from the total gain correcting unit 25 and the audio signals supplied from the amplifier 31, and supplies the generated audio signals to the amplifier 33.

Specifically, with one of the N channels corresponding to the reproduction speakers 12 being an attention channel nc, the amplifier 32 multiplies the reproduction gains of the respective ideal speakers with respect to the attention channel nc by the audio signals of the respective ideal speakers. The amplifier 32 then sets the one audio signal obtained by combining the audio signals of the respective ideal speakers multiplied by the reproduction gains, or the M audio signals, as the audio signal of the attention channel nc. The same process as above is performed on each of the N channels as the attention channel, so that the audio signals of the M respective ideal speakers are converted into the audio signals of the N reproduction speakers 12.

In step S19, the amplifier 33 performs gain adjustment on the audio signals supplied from the amplifier 32 based on the correction values and delay values of the side of the reproduction speakers 12 supplied from the distance calculating unit 21.

Specifically, as for the audio signal of a channel n for which a correction value and a delay value have been supplied, the amplifier 33 multiplies the audio signal by the correction value $SoundPressureCorrection_{on}$, delays the resultant audio signal by the delay time $Delay_{on}$ in the temporal direction, and supplies the delayed audio signal to the reproduction speakers 12.

After the audio signals of the respective channels are output to the reproduction speakers 12, the down-mixing process comes to an end. Also, the reproduction speakers 12 reproduce sounds based on the audio signals supplied from the reproduction device 11.

In the above-described manner, the reproduction device 11 performs gain adjustment (gain correction) on audio signals in accordance with the distances between the positions of the ideal speakers and the positions of the real reproduction speakers 12. Accordingly, even in a case where there are differences in position between the ideal speaker and the reproduction speakers 12, degradation of the sound quality of output sounds and degradation of the sound image definition can be reduced, and audio reproduction with a more realistic feeling can be realized.

Through the above-described process, the input audio signal(s) of one or more channels can be reproduced by one or more reproduction speakers placed in one or more desired position. Even in a case where the input audio signals of the respective channels are audio signals from respective objects serving as sound sources, audio reproduction in the correct sound image position can be performed through the same down-mixing process as above.

<Encoder and Decoder>

Next, the encoder that encodes the metadata to be supplied to the reproduction device 11, and the decoder that decodes the encoded metadata are described.

Figure 7:
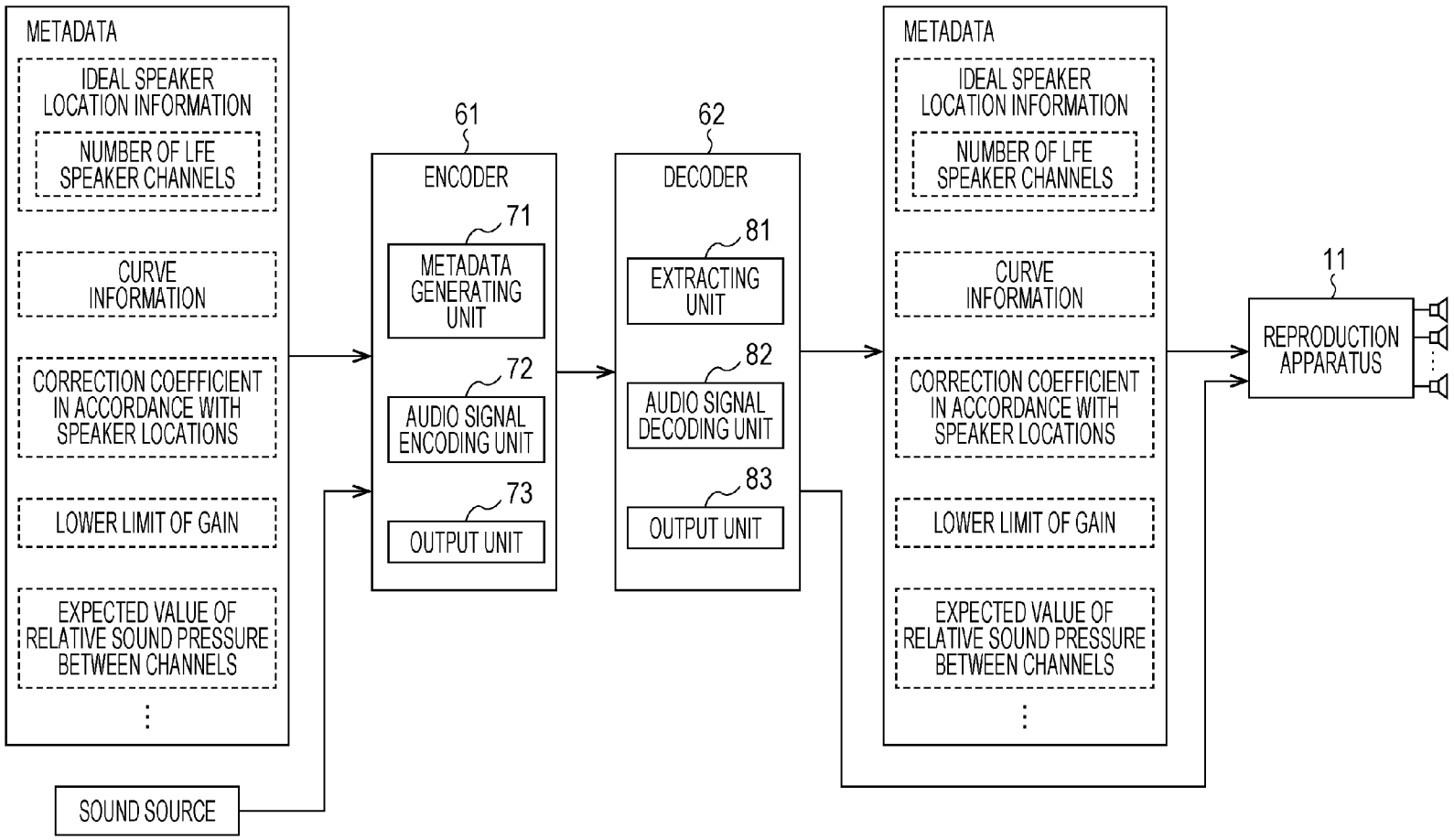
FIG. 7 is a diagram showing an example configuration of an audio system.

As shown in FIG. 7, for example, in an audio system to which the present technology is applied, metadata is supplied from an encoder 61 to a decoder 62, and the metadata is further supplied from the decoder 62 to the reproduction device 11.

The encoder 61 obtains the necessary information for obtaining the metadata from the outside and the audio signals of the M ideal speakers, and generates a bit stream formed with the metadata and the audio signals that have been encoded.

The encoder 61 includes a metadata generating unit 71, an audio signal encoding unit 72, and an output unit 73.

The metadata generating unit 71 obtains the necessary information from the outside, and generates encoded metadata by encoding the obtained information as necessary.

The metadata includes the location information about the respective ideal speakers, the number of ideal speakers for LFE (the number of channels) among the ideal speakers, the curve information, and the curve index, for example. The metadata also includes the information indicating whether it is necessary to correct reproduction gains in accordance with the positions of the reproduction speakers 12, the correction coefficient Max_spkr_pos_correction_coeffcient depending on the positions of the reproduction speakers 12, the gain lower limit $MixGain_{MinThre}$, and the expected values SPR_i (m) of the relative sound pressures between the channels.

The audio signal encoding unit 72 encodes audio signals supplied from the outside. The output unit 73 generates a bit stream containing the encoded metadata and the encoded audio signals, and outputs the bit stream to the decoder 62.

The decoder 62 includes an extracting unit 81, an audio signal decoding unit 82, and an output unit 83. The decoder 62 receives the bit stream transmitted from the encoder 61, and the extracting unit 81 extracts the metadata and the audio signals from the received bit stream. At this point, the extracting unit 81 decodes the metadata, as necessary.

The audio signal decoding unit 82 decodes the audio signals extracted by the extracting unit 81. The output unit 83 supplies the metadata extracted by the extracting unit 81 and the audio signals decoded by the audio signal decoding unit 82 to the reproduction device 11.

Part of the metadata written in a bit stream to be output from the encoder 61 to the decoder 62 is as shown in FIG. 8, for example. That is, FIG. 8 shows the syntax of part of the metadata.

In the example shown in FIG. 8, at the start of the header, "down mix coef exist flag" is placed as the information indicating whether the necessary information for downmixing is included in the metadata.

Also, in the metadata, "down mix coef mode" is placed as the curve information, and, under the curve information, "polyline curve idx" or "function curve idx" is placed as the curve index.

The "polyline curve idx" indicates a polyline curve, and, if the value thereof is a binary number "111", the polyline curve is a new polyline curve. In this case, "polyline curve coeffcient[j]" is written as the information for obtaining a new polyline curve.

The information for obtaining a new polyline curve is the information for identifying the respective squares on the polyline CV11 shown in FIG. 2 (these squares will be hereinafter referred to as description points), for example, or for identifying the respective values constituting a numerical sequence.

Specifically, the reproduction gain axis (the ordinate axis) is divided into sixteen, so that sixteen divided lines are defined. The respective description points are sequentially placed on the respective divisional lines along the ordinate axis.

In the metadata, the description points are represented by "0"s, and the information indicating on which divided lines the respective description points are placed is represented by "1"s.

In FIG. 2, the description points are sequentially written from left. First, the information indicating on which divided line counted from the bottom the first description point from left is located is written with the number "1", and thereafter, "0"s representing description points are written. Here, the first description point from left is located on the uppermost divided line, only a "0" representing a description point is written.

Thereafter, the information indicating that the description point is located Q divided lines below the divided line on which the last description line is located is written with Q "1"s, followed by a "0" representing a description point.

For example, the third description point from left is located two divided lines below the second description point. Therefore, two "1"s are written, followed by one "0". Also, the tenth description point from left is located on the same divided line as the ninth description line, or is located zero divided lines below the ninth description line. Therefore, no "1"s are written, and only one "0" is written.

The description is conducted by the above method. If all the description points have been written, one "1" is written to indicate that the information about the polyline curve has been written. If the number of description points is large, and the description points cannot be written even with 64 "1"s and "0"s in total, the description is conducted until the number of "1"s and "0"s reaches 64, and the description is then ended.

Therefore, in a case where the information for obtaining a polyline curve is read from the metadata, the information for sequentially obtaining the respective description points is read until 16 "1"s or 64 "1"s and "0"s in total (the sum of the number of "1"s and the number of "0"s being 64) have been read out. In this manner, a polyline curve is generated.

The "function curve idx" indicates a function curve, and, if the value thereof is a binary number "111", the function curve is a new function curve. In this case, "function_curve_coeffcient[i]" is written as the coefficient of a new function curve.

Meanwhile, "minimun_gain_threshold_idx" written in the metadata is the index indicating the gain low limit $MixGain_{MinThre}$. Further, "gain_correction_coeffcient" written in the metadata is the correction coefficient Max_spkr_pos_correction_coeffcient required in correcting reproduction gains in accordance with the positions of the reproduction speakers 12. If the value of Max_spkr_pos_correction_coeffcient is "1", there is no need to correct reproduction gains in accordance with the positions of the reproduction speakers 12.

Further, in the metadata, "sound_level_exist_flag" is written as the information indicating whether the expected values SPR_i(m) of the relative sound pressures between channels are written in the metadata, and "channel sound level[i]" is written in accordance with the value of "sound_level_exist_flag". Here, "channel sound level[i]" represents the expected values SPR_i(m).

<Explanation of the Encoding Process>

The operations of the encoder 61 and the decoder 62 are further described.

Figure 9:
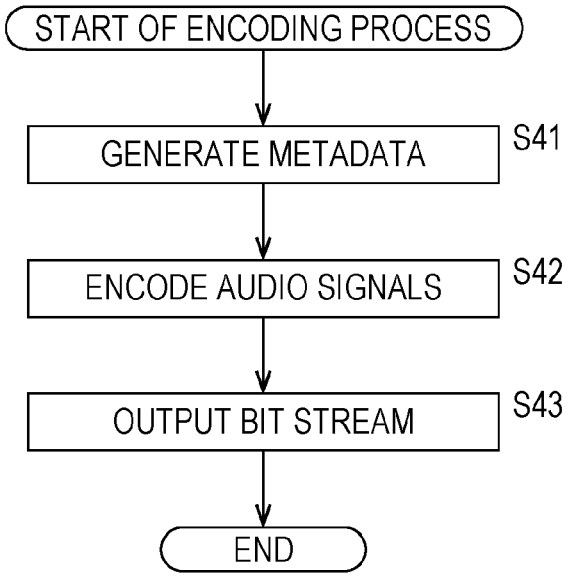
FIG. 9 is a flowchart for explaining an encoding process.

Referring first to the flowchart in FIG. 9, the encoding process to be performed by the encoder 61 is described.

In step S41, the metadata generating unit 71 obtains the necessary information from the outside, and generates encoded metadata by encoding the obtained information. For example, the metadata generating unit 71 generates the metadata corresponding to the syntax shown in FIG. 8.

In step S42, the audio signal encoding unit 72 encodes audio signals supplied from the outside.

In step S43, the output unit 73 generates a bit stream containing the encoded metadata and the encoded audio signals, and outputs the bit stream to the decoder 62. After the bit stream is output, the encoding process comes to an end.

In the above manner, the encoder 61 generates and outputs the metadata including the location information about the ideal speakers, the curve information, and the like. As the information formed with the location information about the ideal speakers, the curve information, and the like is generated as the metadata, the reproduction device 11 can perform appropriate gain correction, such as gain correction in accordance with the distances between the positions of the ideal speakers and the positions of the real reproduction speakers 12. As a result, audio reproduction with a more realistic feeling can be performed.

<Explanation of the Decoding Process>

Figure 10:
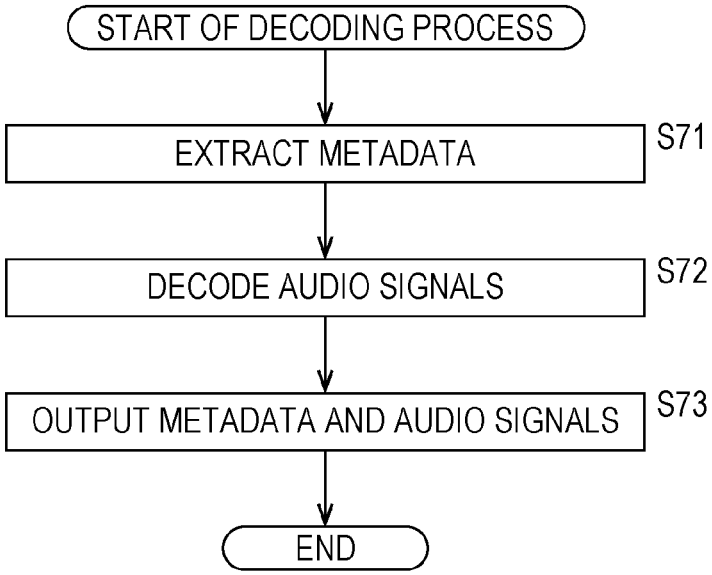
FIG. 10 is a flowchart for explaining a decoding process.

Referring now to the flowchart in FIG. 10, the decoding process to be performed by the decoder 62 is described.

In step S71, the decoder 62 receives a bit stream transmitted from the encoder 61, and the extracting unit 81 extracts metadata and audio signals from the received bit stream. The extracting unit 81 also decodes the metadata.

In step S72, the audio signal decoding unit 82 decodes the audio signals extracted by the extracting unit 81.

In step S73, the output unit 83 outputs the decoded metadata and the decoded audio signals to the reproduction device 11, and the decoding process then comes to an end.

In the above manner, the decoder 62 decodes the metadata and the audio signals, and outputs the metadata including the location information about the ideal speakers, the curve information, and the like, and the audio signals to the reproduction device 11. As the information formed with the location information about the ideal speakers, the curve information, and the like is output as the metadata, the reproduction device 11 can perform appropriate gain correction, such as gain correction in accordance with the distances between the positions of the ideal speakers and the positions of the real reproduction speakers 12. As a result, audio reproduction with a more realistic feeling can be performed.

The above-described series of processes may be performed by hardware or may be performed by software. Where the series of processes are to be performed by software, the program that forms the software is installed into a computer. Here, the computer may be a computer incorporated into special-purpose hardware, or may be a general-purpose computer that can execute various kinds of functions as various kinds of programs are installed thereinto.

Figure 11:
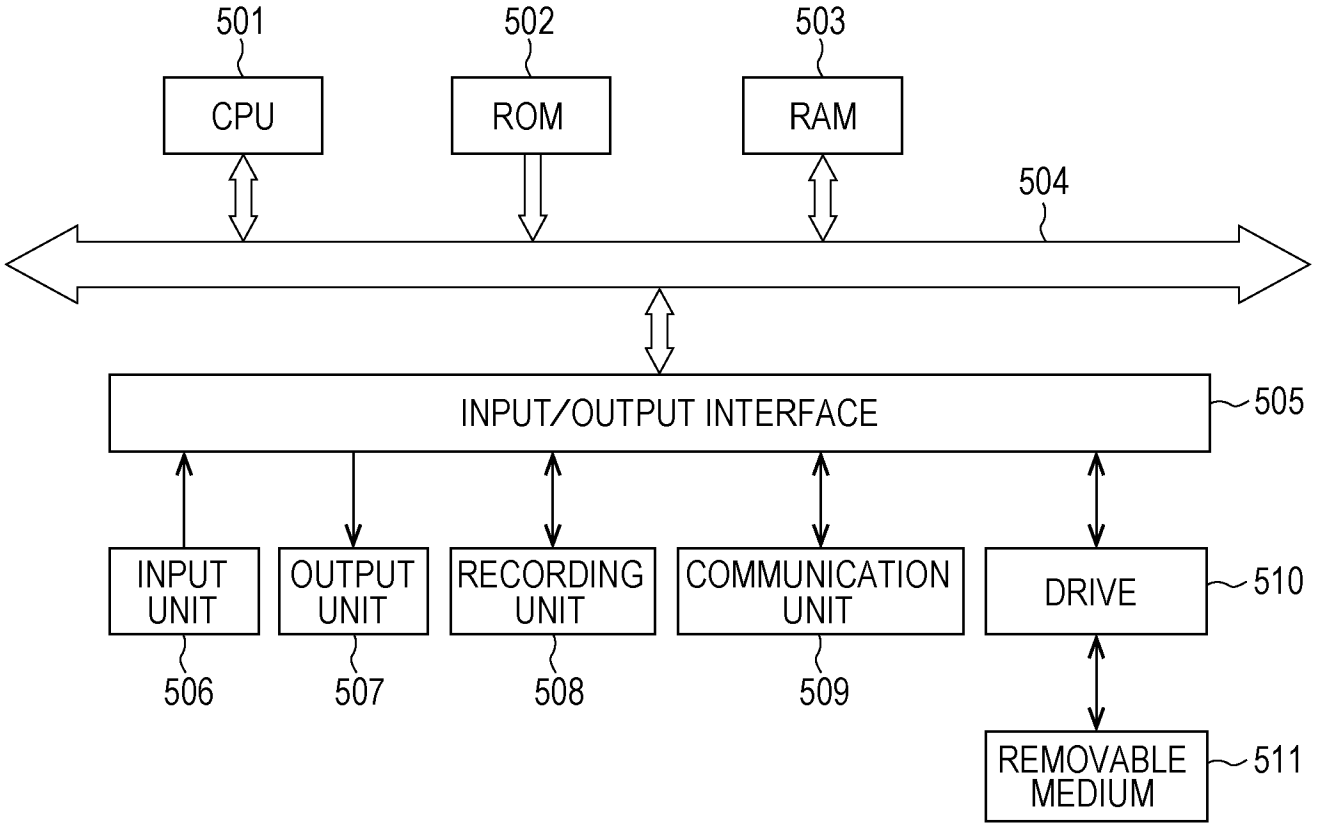
FIG. 11 is a diagram showing an example configuration of a computer.

FIG. 11 is a block diagram showing an example structure of the hardware of a computer that performs the above-described series of processes in accordance with a program.

In the computer, a CPU 501, a ROM 502, and a RAM 503 are connected to one another by a bus 504.

An input/output interface 505 is further connected to the bus 504. An input unit 506, an output unit 507, a recording unit 508, a communication unit 509, and a drive 510 are connected to the input/output interface 505.

The input unit 506 is formed with a keyboard, a mouse, a microphone, an imaging device, and the like. The output unit 507 is formed with a display, a speaker, and the like. The recording unit 508 is formed with a hard disk, a nonvolatile memory, or the like. The communication unit 509 is formed with a network interface or the like. The drive 510 drives a removable medium 511 such as a magnetic disk, an optical disk, a magnetooptical disk, or a semiconductor memory.

In the computer having the above-described structure, the CPU 501 loads a program recorded in the recording unit 508 into the RAM 503 via the input/output interface 505 and the bus 504, for example, and executes the program, so that the above-described series of processes are performed.

The program to be executed by the computer (the CPU 501) may be recorded on the removable medium 511 as a packaged medium to be provided, for example. Alternatively, the program can be provided via a wired or wireless transmission medium such as a local area network, the Internet, or digital satellite broadcasting.

In the computer, the program can be installed into the recording unit 508 via the input/output interface 505 when the removable medium 511 is mounted on the drive 510. The program can also be received by the communication unit 509 via a wired or wireless transmission medium, and be installed into the recording unit 508. Alternatively, the program may be installed beforehand into the ROM 502 or the recording unit 508.

The program to be executed by the computer may be a program for performing processes in chronological order in accordance with the sequence described in this specification, or may be a program for performing processes in parallel or performing a process when necessary, such as when there is a call.

It should be noted that embodiments of the present technology are not limited to the above-described embodiments, and various modifications may be made to them without departing from the scope of the present technology.

For example, the present technology can be embodied in a cloud computing structure in which one function is shared among devices via a network, and processing is performed by the devices cooperating with one another.

The respective steps described with reference to the above-described flowcharts can be carried out by one device or can be shared among devices.

In a case where more than one process is included in one step, the processes included in the step can be performed by one device or can be shared among devices.

Further, the present technology may take the following forms.

[1]

An audio signal output device including:

a distance calculating unit that calculates the distance between the position of an ideal speaker that reproduces an audio signal and the position of a real speaker that reproduces the audio signal;

a gain calculating unit that calculates a reproduction gain of the audio signal based on the distance; and a gain adjusting unit that performs gain adjustment on the audio signal based on the reproduction gain.

[2]

The audio signal output device of [1], wherein the gain calculating unit calculates the reproduction gain based on curve information for obtaining the reproduction gain corresponding to the distance.

[3]

The audio signal output device according to [2], wherein the curve information is information indicating a polyline curve or a function curve.

[4]

The audio signal output device according to [1] or [2], wherein, when the ideal speaker is not located on a unit circle having a predetermined reference point as its center point, the gain adjusting unit further performs gain adjustment on the audio signal with a gain determined based on the distance from the reference point to the ideal speaker and the radius of the unit circle.

[5]

The audio signal output device according to [4], wherein the gain adjusting unit delays the audio signal based on a delay time determined based on the distance from the reference point to the ideal speaker and the radius of the unit circle.

[6]

The audio signal output device according to [1] or [2], wherein, when the real speaker is not located on a unit circle having a predetermined reference point as its center point, the gain adjusting unit further performs gain adjustment on the audio signal with a gain determined based on the distance from the reference point to the real speaker and the radius of the unit circle.

[7]

The audio signal output device according to [6], wherein the gain adjusting unit delays the audio signal based on a delay time determined based on the distance from the reference point to the real speaker and the radius of the unit circle.

[8]

The audio signal output device according to any one of [1] through [7], further including a gain correcting unit that corrects the reproduction gain based on the distance between the position of an ideal center speaker and the position of the real speaker.

[9]

The audio signal output device according to any one of [1] through [8], further including a lower limit correcting unit that corrects the reproduction gain when the reproduction gain is smaller than a predetermined lower limit.

[10]

The audio signal output device according to any one of [1] through [9], further including a total gain correcting unit that calculates a ratio between the total power of an output sound based on the audio signal subjected to the gain adjustment with the reproduction gain and the total power of an input sound, and corrects the reproduction gain based on the ratio, the ratio being calculated based on the reproduction gain and an expected value of the sound pressure of the input sound based on the audio signal input.

[11]

An audio signal output method including the steps of:

calculating the distance between the position of an ideal speaker that reproduces an audio signal and the position of a real speaker that reproduces the audio signal;

calculating a reproduction gain of the audio signal based on the distance; and performing gain adjustment on the audio signal based on the reproduction gain.

[12]

A program for causing a computer to perform a process including the steps of:

calculating the distance between the position of an ideal speaker that reproduces an audio signal and the position of a real speaker that reproduces the audio signal;

calculating a reproduction gain of the audio signal based on the distance; and performing gain adjustment on the audio signal based on the reproduction gain.

[13]

An encoding device including:

a correction information generating unit that generates correction information for correcting a gain of an audio signal in accordance with the distance between the position of an ideal speaker that reproduces the audio signal and the position of a real speaker that reproduces the audio signal;

an encoding unit that encodes the audio signal; and an output unit that outputs a bit stream including the correction information and the encoded audio signal.

[14]

An encoding method including the steps of:

generating correction information for correcting a gain of an audio signal in accordance with the distance between the position of an ideal speaker that reproduces the audio signal and the position of a real speaker that reproduces the audio signal;

encoding the audio signal; and outputting a bit stream including the correction information and the encoded audio signal.

[15]

A decoding device including:

an extracting unit that extracts, from a bit stream, correction information for correcting a gain of an audio signal in accordance with the distance between the position of an ideal speaker that reproduces the audio signal and the position of a real speaker that reproduces the audio signal, and the encoded audio signal;

a decoding unit that decodes the encoded audio signal; and an output unit that outputs the decoded audio signal and the correction information.

[16]

The decoding device according to [15], wherein the correction information is the location information about the ideal speaker.

[17]

The decoding device according to [15] or [16], wherein the correction information is curve information for obtaining a gain corresponding to the distance.

[18]

The decoding device according to [17], wherein the curve information is information indicating a polyline curve or a function curve.

[19]

A decoding method including the steps of:

extracting, from a bit stream, correction information for correcting a gain of an audio signal in accordance with the distance between the position of an ideal speaker that reproduces the audio signal and the position of a real speaker that reproduces the audio signal, and the encoded audio signal;

decoding the encoded audio signal; and outputting the decoded audio signal and the correction information.

REFERENCE SIGNS LIST

11 Reproduction device
21 Distance calculating unit
22 Reproduction gain calculating unit
23 Correcting unit
24 Lower limit correcting unit
25 Total gain correcting unit
26 Gain adjusting unit
61 Encoder
62 Decoder
71 Metadata generating unit
72 Audio signal encoding unit
73 Output unit
81 Extracting unit
82 Audio signal decoding unit
83 Output unit

The invention claimed is:

1. An audio signal output device, comprising:

a distance calculating unit configured to calculate a distance between a position of an ideal speaker that reproduces an audio signal and a position of a real speaker that reproduces the audio signal;

a gain calculating unit configured to calculate a reproduction gain of the audio signal based on the distance;

a gain adjusting unit configured to adjust gain of the audio signal based on the reproduction gain; and a total gain calculating unit configured to correct the reproduction gain based on a ratio of total power of an output sound and total power of an input sound, wherein the total power of an output sound is based on the audio signal subjected to the gain adjustment with the reproduction gain, and the total power of an input sound is based on an expected value of sound pressure of the input sound based on the audio signal.

2. The audio signal output device according to claim 1, wherein the gain calculating unit is further configured to calculate the reproduction gain based on curve information to obtain the reproduction gain corresponding to the distance.

3. The audio signal output device according to claim 2, wherein the curve information is information indicating one of a polyline curve or a function curve.

4. The audio signal output device according to claim 1, wherein, based on a location of the ideal speaker that is other than on a unit circle which has a reference point as a center point thereof, the gain adjusting unit is further configured to adjust gain on the audio signal with a gain determined based on a distance from the reference point to the ideal speaker and a radius of the unit circle.

5. The audio signal output device according to claim 4, wherein the gain adjusting unit is further configured to delay the audio signal based on a delay time determined based on the distance from the reference point to the ideal speaker and the radius of the unit circle.

6. The audio signal output device according to claim 1, wherein, based on a location of the real speaker that is other than on a unit circle which has a reference point as a center point thereof, the gain adjusting unit is further configured to adjust gain on the audio signal with a gain determined based on a distance from the reference point to the real speaker and a radius of the unit circle.

7. The audio signal output device according to claim 6, wherein the gain adjusting unit is further configured to delay the audio signal based on a delay time determined based on the distance from the reference point to the real speaker and the radius of the unit circle.

8. The audio signal output device according to claim 1, further comprising a gain correcting unit configured to correct the reproduction gain based on a distance between a position of an ideal center speaker and the position of the real speaker.

9. The audio signal output device according to claim 1, further comprising a lower limit correcting unit configured to correct the reproduction gain based on the reproduction gain that is smaller than a particular lower limit.

10. An audio signal output method, comprising:

calculating a distance between a position of an ideal speaker reproducing an audio signal and a position of a real speaker reproducing the audio signal;

calculating a reproduction gain of the audio signal based on the distance;

adjusting gain of the audio signal based on the reproduction gain; and correcting the reproduction gain based on a ratio of total power of an output sound and total power of an input sound, wherein the total power of an output sound is based on the audio signal subjected to the gain adjustment with the reproduction gain, and the total power of an input sound is based on an expected value of sound pressure of the input sound based on the audio signal.

11. A non-transitory computer-readable medium having stored thereon computer-readable instructions, which when executed by a computer, cause the computer to execute operations, the operations comprising:

calculating a distance between a position of an ideal speaker reproducing an audio signal and a position of a real speaker reproducing the audio signal;

calculating a reproduction gain of the audio signal based on the distance;

adjusting gain of the audio signal based on the reproduction gain; and correcting the reproduction gain based on a ratio of total power of an output sound and total power of an input sound, wherein the total power of an output sound is based on the audio signal subjected to the gain adjustment with the reproduction gain, and the total power of an input sound is based on an expected value of sound pressure of the input sound based on the audio signal.

12. An encoding device, comprising:

a correction information generating unit configured to generate correction information to correct a gain of an audio signal based on a distance between a position of an ideal speaker that reproduces the audio signal and a position of a real speaker that reproduces the audio signal;

an encoding unit configured to encode the audio signal; and an output unit configured to:

calculate a reproduction gain of the audio signal based on the distance;

correct the reproduction gain based on a ratio of total power of an output sound and total power of an input sound; and output a bit stream including the correction information and the encoded audio signal, wherein the total power of an output sound is based on the audio signal subjected to a gain adjustment based on the reproduction gain, and the total power of an input sound is based on an expected value of sound pressure of the input sound based on the audio signal.

13. An encoding method, comprising:

generating correction information for correcting a gain of an audio signal based on a distance between a position of an ideal speaker reproducing the audio signal and a position of a real speaker reproducing the audio signal;

encoding the audio signal;

calculating a reproduction gain of the audio signal based on the distance;

correcting the reproduction gain based on a ratio of total power of an output sound and total power of an input sound, wherein the total power of an output sound is based on the audio signal subjected to a gain adjustment based on the reproduction gain, and the total power of an input sound is based on an expected value of sound pressure of the input sound based on the audio signal; and outputting a bit stream including the correction information and the encoded audio signal.

14. A decoding device, comprising:

an extracting unit configured to extract, from a bit stream, correction information to correct a gain of an audio signal based on a distance between a position of an ideal speaker that reproduces the audio signal and a position of a real speaker that reproduces the audio signal, and an encoded audio signal;

a decoding unit configured to decode the encoded audio signal; and an output unit configured to:

calculate a reproduction gain of the audio signal based on the distance;

correct the reproduction gain based on a ratio of total power of an output sound and total power of an input sound; and output the decoded audio signal and the correction information, wherein the total power of an output sound is based on the audio signal subjected to a gain adjustment based on the reproduction gain, and the total power of an input sound is based on an expected value of sound pressure of the input sound based on the audio signal.

15. The decoding device according to claim 14, wherein the correction information is location information about the ideal speaker.

16. The decoding device according to claim 14, wherein the correction information is curve information to obtain a gain corresponding to the distance.

17. The decoding device according to claim 16, wherein the curve information is information indicating one of a polyline curve or a function curve.

18. A decoding method, comprising:

extracting, from a bit stream, correction information for correcting a gain of an audio signal based on a distance between a position of an ideal speaker reproducing the audio signal and a position of a real speaker reproducing the audio signal, and an encoded audio signal;

decoding the encoded audio signal;

calculating a reproduction gain of the audio signal based on the distance;

correcting the reproduction gain based on a ratio of total power of an output sound and total power of an input sound, wherein the total power of an output sound is based on the audio signal subjected to a gain adjustment based on the reproduction gain, and the total power of an input sound is based on an expected value of sound pressure of the input sound based on the audio signal; and outputting the decoded audio signal and the correction information.

* * * * *